United States Patent [19]

Evert

[11] Patent Number: 4,498,882

[45] Date of Patent: Feb. 12, 1985

[54] HYBRID PERSONAL FLOTATION DEVICE

[75] Inventor: Karla R. Evert, St. Cloud, Minn.

[73] Assignee: Stearns Manufacturing Company, St. Cloud, Minn.

[21] Appl. No.: 473,221

[22] Filed: Mar. 8, 1983

[51] Int. Cl.[3] ..... B63C 9/16

[52] U.S. Cl. ..... 441/116; 441/107

[58] Field of Search ..... 441/88–119; 116/208, 210

[56] References Cited

U.S. PATENT DOCUMENTS

| | | | |
|---|---|---|---|
| 3,090,979 | 5/1963 | Segrest | 441/95 |
| 3,877,096 | 4/1975 | Scesney | 116/210 |
| 4,060,867 | 12/1977 | Miller | 441/92 |
| 4,097,947 | 7/1978 | Keifer | 441/116 |
| 4,131,974 | 1/1979 | Bolton et al. | 441/118 |
| 4,137,586 | 2/1979 | Evert | 441/107 |
| 4,167,051 | 9/1979 | Galecke | 441/117 |

FOREIGN PATENT DOCUMENTS

| | | | |
|---|---|---|---|
| 2256324 | 5/1973 | Fed. Rep. of Germany | 441/118 |

OTHER PUBLICATIONS

Brochure—Offshore Products, Inc. (2 pages).

*Primary Examiner*—Trygve M. Blix
*Assistant Examiner*—Jesûs D. Sotelo
*Attorney, Agent, or Firm*—Merchant, Gould, Smith, Edell, Welter & Schmidt

[57] ABSTRACT

A hybrid personal flotation device (10) of the type having a required buoyancy is disclosed. The flotation device (10) includes a mass of buoyant material (12*a*), (12*b*) and (12*c*) providing an amount of inherent buoyancy and an inflatable buoyancy chamber (18) cooperatively connected to the mass of buoyant material (12*a*), (12*b*) and (12*c*). The buoyancy chamber (18) is inflated with gas for providing supplemental buoyancy. The buoyancy chamber (18) may be deflated, whereby after the factory testing of said inflatable buoyancy chamber (18) by inflating and deflating the buoyancy chamber (18), a residual amount of gas that is used to inflate the buoyancy chamber (18) remains in the buoyancy chamber (18) after deflation, and provides an amount of residual buoyancy. The inherent buoyancy plus the residual buoyancy being greater than or equal to the required buoyancy. In a preferred embodiment, the buoyancy chamber (18) is covered by a covering panel (32). A panel portion includes the mass of buoyant material (12*a*), (12*b*) and (12*c*). The covering panel has outer edges releasably connected to the panel portion, whereby when the buoyancy chamber (18) is uninflated, the outer edge of the covering panel is secured to the panel portion and the buoyancy chamber (18) is folded and hidden from view by the covering panel (32) and when the buoyancy chamber (18) is inflated, the outer edges of the covering panel (32) are released and the buoyancy chamber (18) expands, unfolds and is visible.

11 Claims, 10 Drawing Figures

FIG. 8
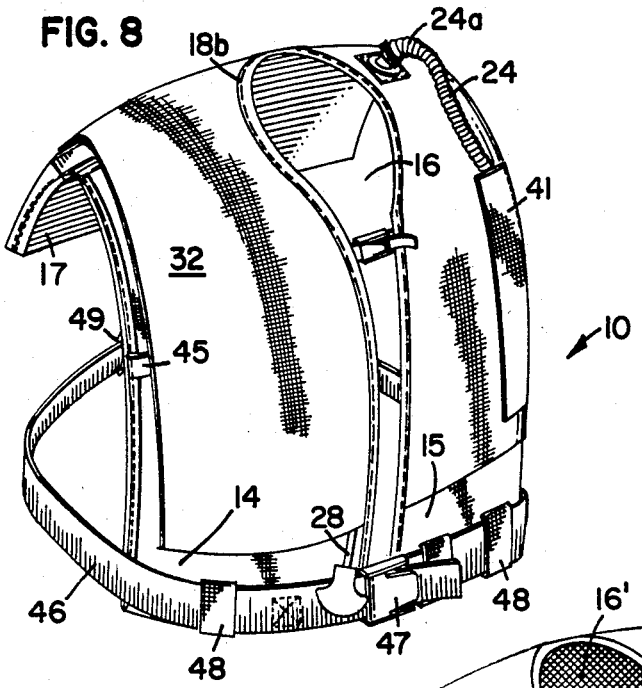
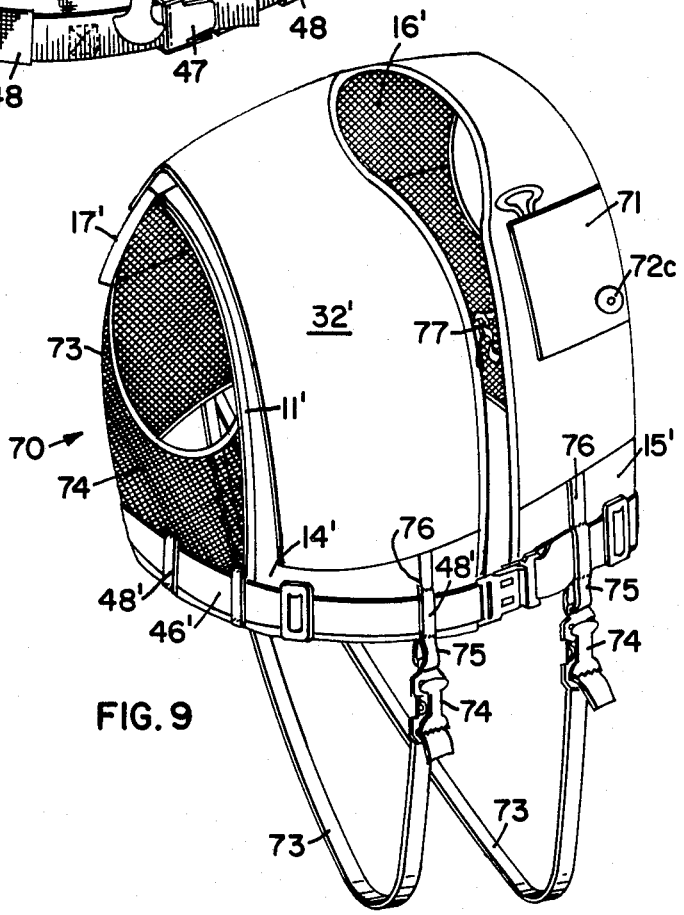
FIG. 9

HYBRID PERSONAL FLOTATION DEVICE

BACKGROUND OF THE INVENTION

1. Field of the Invention

This invention relates generally to hybrid personal flotation devices and in particular to flotation devices having both a mass of buoyant material and an inflatable buoyancy chamber.

2. Description of the Prior Art

In designing flotation devices for use in connection with boating or aviation, the United States Coast Guard and Underwriters Laboratory establish the standards by which the flotation devices are approved for the marketplace. Consequently, no matter how effective a flotation device may be, if it does not meet the Coast Guard or Underwriters Laboratory's standards, its marketability will be extremely limited.

One of the Coast Guard requirements is that there be a minimum buoyancy of 15½ pounds for an adult life vest or jacket, noting that previous studies have shown that 95% of the adult male population requires less than 12 pounds of buoyancy to remain afloat.

In the past, some life jackets (i.e. with sleeves) have been manufactured and sold which include both fixed or inherent buoyancy (i.e. foam or similar materials) and a provision for supplementing that buoyancy with, for example, air inflation provided through a tube by the wearer. However, in so far as is presently known, the amount of inherent buoyancy in such flotation devices was typically on the order of 15½ pounds or greater, which is the minimum buoyancy standard set by the Coast Guard.

One of the major disadvantages of having a large amount of inherent buoyancy in a flotation device is that the mass of material required to provide the inherent buoyancy increases the bulk of the flotation discomfort.

In addition, prior art personal flotation devices were constructed such that the entire flotation device inflates. Therefore, to allow for the expansion of the buoyancy chamber, it was necessary for the material covering the buoyancy chamber to have a sufficient amount of extra material to allow for the complete expansion of the buoyancy chamber. This extra material also added to the bulk of the flotation device.

The present invention addresses the problems associated with the prior art flotation devices and provides for a hybrid personal flotation device which includes a minimal amount of inherent buoyancy plus a residual buoyancy from an inflatable buoyancy chamber to provide the required buoyancy as set by either the United States Coast Guard, Underwriters Laboratories or other organizations. In addition to the residual buoyancy of the buoyancy chamber, the buoyancy chamber also provides supplemental buoyancy to exceed the required buoyancy standard.

SUMMARY OF THE INVENTION

The present invention is a hybrid personal flotation device of the type having a required buoyancy. The hybrid personal flotation devices includes a mass of buoyant material providing an amount of inherent buoyancy. An inflatable buoyancy chamber is cooperatively connected to the massive buoyant material. Also included is a means for inflating the buoyancy chamber with gas. The inflated buoyancy chamber provides for supplemental buoyancy. A means for deflating the buoyancy chamber is also provided. After factory testing of the inflatable buoyancy chamber by inflating and deflating the buoyancy chamber, a residual amount of gas that is used to inflate the buoyancy chamber remains in the buoyancy chamber after deflation and provides an amount of residual buoyancy. The inherent buoyancy plus the residual buoyancy is greater than or equal to the required buoyancy.

In accordance with another aspect of the invention, a hybrid personal flotation device is provided which includes a chest portion having a mass of buoyant material. The chest portion has an inner surface and an outer surface. The inner surface being adjacent to the body of a wearer. The hybrid personal flotation device also includes a buoyancy chamber having an interior zone and a peripheral zone. A portion of the interior zone is cooperatively connected to the chest portion. The peripheral zone being unattached to the chest portion, whereby the peripheral zone may be folded and when the buoyancy chamber is folded, the buoyancy chamber covers a smaller area than when the buoyancy chamber is unfolded. A means for inflating the buoyancy chamber is provided. A covering panel is cooperatively connected to the chest portion. The buoyancy chamber is positioned between the chest portion and the covering panel. The covering panel has outer edges releasably connected to the chest portion, whereby when the buoyancy chamber is uninflated, the outer edge of the covering panel is secured to the chest portion and the buoyancy chamber is folded and hidden from view by the covering panel. When the buoyancy chamber is inflated, the outer edges of the covering panel are released and the buoyancy chamber expands, unfolds and is visible.

BRIEF DESCRIPTION OF THE DRAWING

FIG. 8 is a perspective view, generally viewed as from above, of the personal flotation device shown in FIG. 1;

FIG. 9 is a perspective view, generally viewed as from above, of another embodiment incorporating my present invention.

DETAILED DESCRIPTION OF THE INVENTION

Figure 1:
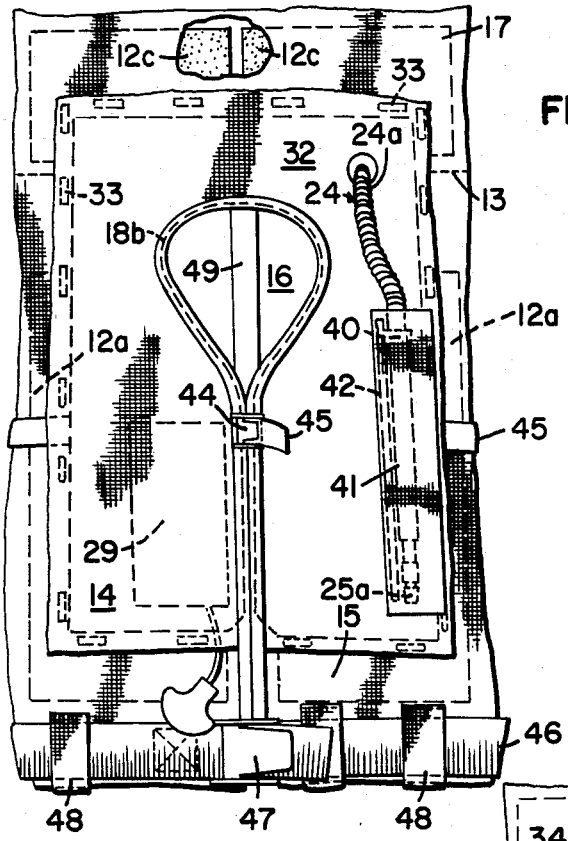
FIG. 1 is a front plan view of the hybrid personal flotation device incorporating my present invention.

Referring to the drawings, where like numerals represent like parts throughout the several views, there is generally designated as 10, a hybrid personal flotation device.

The flotation device 10 has an interior panel 11 having three chambers, 11*a*, 11*b* and 11*c*. The interior panel 11 is formed from a suitable fabric. A mass of buoyant material 12*a* is positioned in chamber 11*a*, a mass of buoyant material 12*b* is positioned in chamber 11*b* and two masses of buoyant material 12*c* are positioned in chamber 11*c*. Stitching 13 prevents the buoyant material 12*c* from leaving chamber 11*c*. The buoyant material 12*a*, 12*b* and 12*c* may be any suitable buoyant material such as a closed cell polyethylene or polyvinylchloride foam. The area defined by the buoyant material 12*a* is generally referred to as the right front panel 14 and the area defined by the buoyant material 12*b* is generally referred to as the left front panel 15. The right front panel 14 and left front panel 15 are not connected and form a neck opening 16. The area defined by the buoyant material 12*c* is generally referred to as the back collar section 17.

Figure 3:
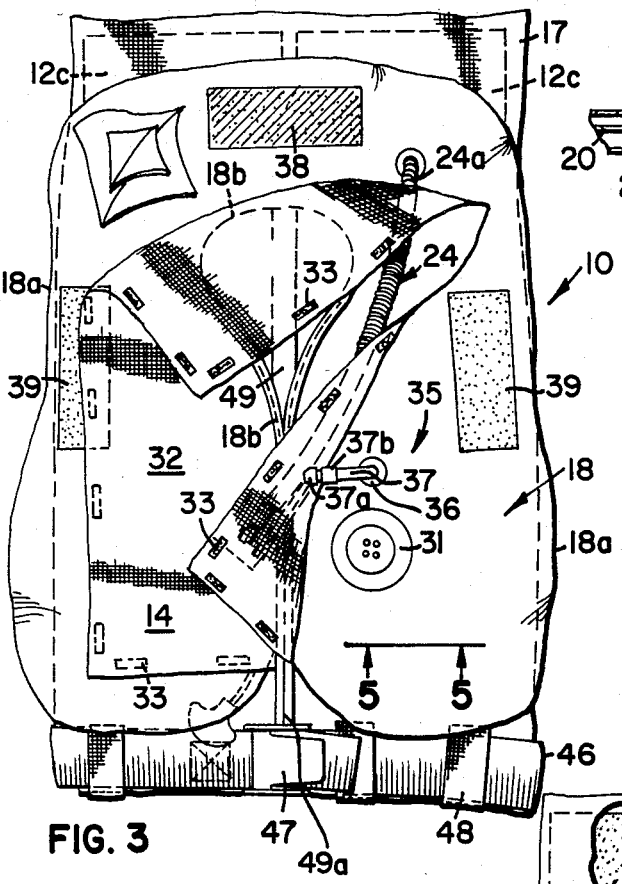
FIG. 3 is a front plan view of the hybrid personal flotation device shown in FIG. 1, with portions of the covering panel released and the buoyancy chamber unfolded.

An inflatable buoyancy chamber 18 is cooperatively connected to the interior panel 11 which cover the buoyant materials 12*a*, 12*b* and 12*c*. The inflatable buoyant chamber 18 is in the general shape of a horseshoe when it is unfolded, as shown in FIG. 3. The inflatable buoyancy chamber 18 has an outside edge 18*a* and an interior edge 18*b*. The interior edge 18*b* and the area immediately surrounding the interior edge 18*b* can be viewed as an interior zone with the remainder of the buoyancy chamber 18, including the outer edges 18*a* comprising a generally peripheral zone. The interior edges 18*b* are cooperatively connected to the interior panel 11 and the outer edges 18*a* are unattached to the interior panel 11. Thereby, the outer edges 18*a* and the peripheral zone may be folded so that the buoyancy chamber 18 covers a smaller area when it is in its stored position, as shown in FIG. 1. The buoyancy chamber 18 is preferably a safety color, i.e. orange.

Figure 5:
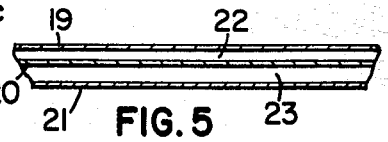
FIG. 5 is a cross-sectional view of the hybrid personal flotation device shown in FIG. 3, taken generally along the line 5—5.

As shown in FIG. 5, the buoyancy chamber 18 includes an outer member 19, a separation member 20 and an inner member 21. The outer member 19, separation member 20 and inner member 21 are cooperatively connected, by heat sealing or other suitable means, along their edges to form an inflatable buoyancy chamber having two separately inflatable chambers. The chamber between the outer member 19 and the separation member 20 is designated as 22 and the chamber between the separation member 20 and inner member 21 is designated as 23. As will be more fully described hereinafter, the chamber 22 will be referred to as the carbon dioxide chamber and the chamber 23 referred to as the air chamber. The members 19, 20 and 21 may be made out of any suitable material, such as heat sealable nylon twill. The edges of the members 19, 20 and 21 are heat sealed forming the outer edges 18*a* and interior edges 18*b* of the inflatable buoyancy chamber 18. It is understood that other suitable methods of forming air tight chambers 22 and 23 may be used, depending upon the type of material used for the members 19, 20 and 21. It is understood that while the preferred embodiment has two chambers 22 and 23, a single inflatable chamber only may be used.

Cooperatively connected to the buoyancy chamber 18 are retro reflective strips 38 and radar reflective strips 39.

The heat seal extends along the full outer edge 18*a* and interior edge 18*b* and bonds the three layers 19, 20 and 21 together in a sealed relationship, thereby defining the chambers 22 and 23. The three layers of materials remain separate with respect to each other except for the heat sealed areas and thus will extend apart from each other as compressed gas is introduced into the respective chambers 22 and 23.

Figure 2:
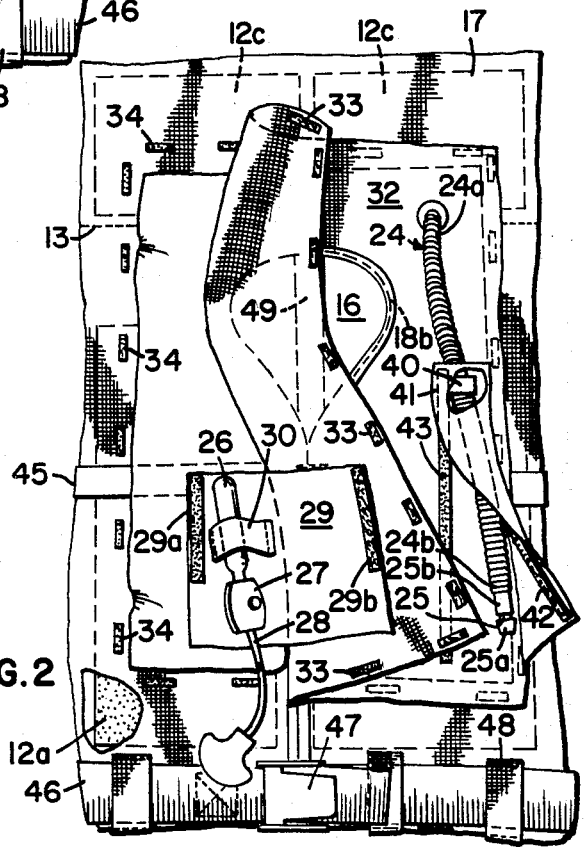
FIG. 2 is a front plan view of the hybrid personal flotation device shown in FIG. 1, with portions of the covering panel being released.

An oral inflater tube 24 having a first end 24*a* is cooperatively connected in a gas-tight manner to the air chamber 23. It is well-known in the art how to cooperatively connect the first end 24*a* in fluid communication with the air chamber 23. One such method is to dielectrically seal the first end 24*a* to the air chamber 23. The second end 24*b* of the oral inflater tube 24 has a check valve cooperatively connected in a gas-tight manner to it. The check valve 25 is of the well-known type having a mouth piece 25*a* and body 25*b*. The mouth piece 25*a* is normally in the extended position as shown in FIG. 2. In this position, the check valve 25 does not allow air either into or out of the air chamber 23. When the mouth piece 25*a* is pushed into the body 25*b*, the check valve 25 is in an open position and air is allowed to either enter or exit the air chamber 23.

In a preferred embodiment, the selected inflating means for inflating the carbon dioxide chamber 22 uses carbon dioxide. It is well known in the art how to inflate a buoyancy chamber. The inflating means includes a replaceable compressed gas cartridge 26, i.e., a container filled with 16 grams of carbon dioxide. The gas cartridge 26 has an end which is threaded into a manifold valve portion 27. A seal at the threaded end (not shown) of the cartridge 26 is provided which may be punctured to release the compressed gas from the container 26 into the manifold valve portion 27. The manifold valve portion 27 has a flange portion (not shown) which secures the valve portion 27 to the carbon dioxide chamber 22. The securement of the flange in fluid communication with the carbon dioxide chamber is well known in the art. The valve portion 27 includes a lever which is activated by a lanyard 28 which will allow manual activation of the inflating means for release of the compressed gas into the carbon dioxide chamber 22. A person need only pull down on the hanging lanyard 28 in order to cause a puncturing of the seal of the compressed gas container and thereby effect an inflation of the carbon dioxide chamber 22. The inflating means is positioned on top of the buoyancy chamber 18. A first portion of a cover 29 is secured to the buoyancy chamber 18 so as to be between the buoyancy chamber 18 and the gas cartridge 26. It is of course necessary for the flange of the manifold valve portion to go through the first portion of the cover 29 to be in fluid communication with the carbon dioxide chamber 22. A second portion of the cover 29 is free to be folded over the top of the gas cartridge and manifold valve 27 to enclose the gas cartridge 26 and manifold valve 27. The first portion of the cover 29 has a velcro strip 29*a* and the second portion of the cover 29 has a corresponding velcro strip 29*b* to provide for releasably securing the two portions of the cover 29 to form a pocket for the gas cartridge 26 and manifold valve 27. The lanyard 28 extends below the bottom edge of the cover 29. A holding strip 30 has both ends secured to the cover 29 forming a loop within which the gas cartridge 26 is stored.

A deflating means 35 is provided to allow for the release of the carbon dioxide from the $CO_2$ chamber 22. The deflating means 35 includes an outlet tube 36 that is cooperatively connected to the $CO_2$ chamber 22 and is in fluid communication with the $CO_2$ chamber 22. A check valve 37 having a mouth piece 37*a* and body 37*b* is cooperatively connected to the outlet tube 36. The check valve 37 is similar to the check valve 25 in operation and construction.

A pressure relief valve 31 is in fluid communication with the carbon dioxide chamber 22. Any suitable pressure relief valve may be used. The pressure relief valve 31 is attached to the buoyancy chamber 18 with an adhesive. The relief valve is set to release at a predetermined internal pressure.

A covering panel 32 is cooperatively connected to the panel 11. The covering panel 32 is of a shape similar to that of the panel 11, except it is slightly smaller in size. Preferably, the covering panel 32 is secured to the interior edge of the panel 11 along the horseshoe shaped opening. Velcro fasteners 33 are secured to the underneath side of the outer edges of the covering panel 33. Matching velcro strips 34 are secured to the panel 11. By securing the velcro strips 33 and 34 to each other, the covering panel 32 is firmly in place and encloses the folded buoyancy chamber 18. Preferably, the covering panel 32 and the panel 11 are of an aesthetically pleasing color. The covering panel 32 hides the safety color of the buoyancy chamber 18 when the buoyancy chamber 18 is not in use.

A strip of fabric 40 is looped to form a circle and is secured to the covering panel 32 by stitching or other appropriate means. The oral inflater tube 24 is passed through the loop formed by the strip 40. An elongate covering panel 41 has a first edge secured to the covering panel 32. The opposite edge of the cover panel 41 has a velcro strip 42 secured to it. A corresponding velcro strip 43 is secured to the covering panel 32. The covering panel 41 is thereby releasably secured to the covering panel 32 and serves to enclose and protect the oral inflater tube 24 when not in use.

A cam-type buckle 44 and strap 45 are cooperatively connected respectively to the right front panel 14 and left front panel 15. The buckle releasably secures the strap 45 and provides for means for securing the right front panel 14 proximate to the left front panel 15. A belt 46 is secured to the bottom portion of the flotation device 10 by loops 48. A cam buckle 47 is attached to the belt 46 and is used to secure the flotation device 10 around the waist of the wearer. It is understood that any appropriate fastening means may be used in place of buckle 44, strap 45, belt 46, buckle 47 and loop 48. A back strap 49 has a first end 49*a* looped around the buckle 47 and a second end 49*b* secured to the back of the panel 11 proximate the neck opening 16.

In operation, a person places the personal flotation device 10 on his upper body and secures the personal flotation device 10 by buckles 44 and 47. The buoyancy chamber 18 is folded and is secured behind the covering panel 32, thereby hiding the safety color from view. The mass of buoyant material 12*a*, 12*b* and 12*c* provide an amount of inherent buoyancy. The buoyancy chamber 18 has been factory tested by inflating and deflating the buoyancy chamber 19. After the deflation of the buoyancy chamber 18 in the factory, a residual amount of gas that is used to inflate the buoyancy chamber 18 remains in the buoyancy chamber 18 after deflation and provides for an amount of residual buoyancy. The inherent buoyancy of the buoyant material 12*a*, 12*b* and 12*c* plus the residual buoyancy of the gas still in the deflated buoyancy chamber 18 is greater than or equal to a required buoyancy that may be necessary to pass an established standard for such personal flotation devices. The mass of buoyant material provides for an inherent buoyancy that is less than the required buoyancy. By having the inherent buoyancy be less than the required buoyancy, it is possible to make the personal flotation device 10 lighter and/or of a shorter length. The lightness and shortened length accommodates workmen who may be required to wear the personal flotation devices while working and still allow for maximum flexibility and mobility while working. The shortened length gives workmen the ability to bend at the waist more easily. If the wearer of the personal flotation device 10 is in water and requires supplemental buoyancy, the supplemental buoyancy can be provided by either the oral inflater tube 24 or the gas cartridge 26. To use the oral inflater tube 24, the cover 41 is pulled away from the covering panel 32. The velcro strips 42 and 43 are separated and the check valve 25 is exposed. The wearer then presses down the mouth piece 25*a* and blows air into the air chamber 23. As air is blown into the air chamber 23, the buoyancy chamber 18 begins to expand, causing the velcro strips 33 and 34 to separate. The buoyancy chamber 18 unfolds into its enlarged form, exposing the safety color of the buoyancy chamber 18 along with the retro reflective tape 38 and radar reflective tape 39. Alternately, the lanyard 28 may be pulled releasing the compressed carbon dioxide gas into the carbon dioxide chamber 22. The release of the compressed carbon dioxide gas 22 would likewise expand the buoyancy chamber 18 releasing the velcro strips 33 and 34 from each other, exposing the buoyancy chamber 18. If a large amount of supplemental buoyancy is needed, both the oral inflater tube and the compressed gas cartridge may be used together. The pressure relief valve 31 prevents the carbon dioxide chamber 23 from being over inflated.

Figure 6:
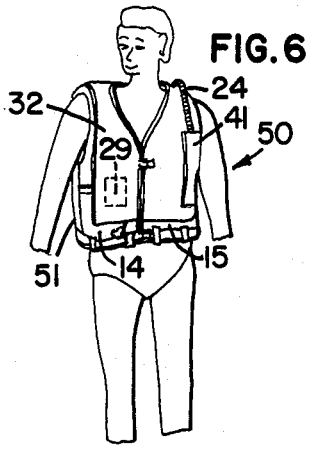
FIG. 6 is a perspective view of another embodiment incorporating my present invention.
Figure 4:
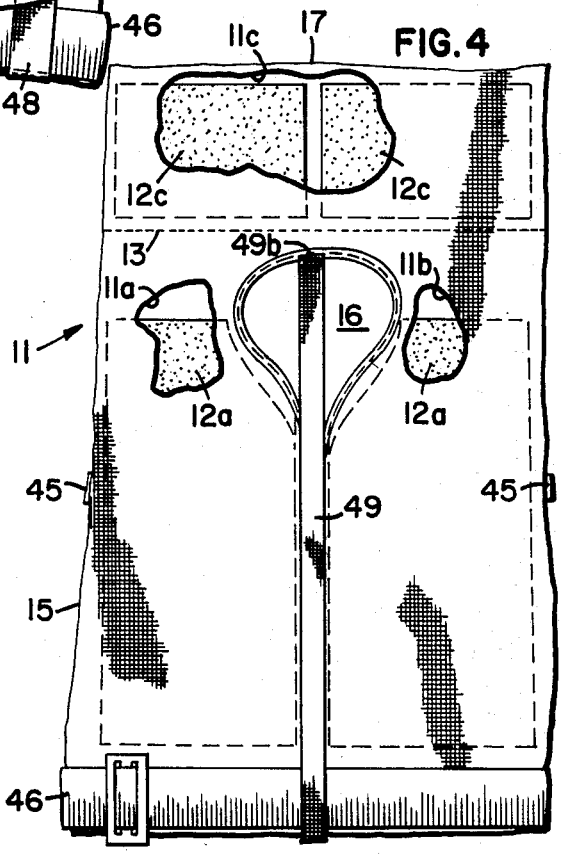
FIG. 4 is a bottom plan view of the hybrid personal flotation device shown in FIG. 1.

Referring now to FIG. 6, another embodiment of a personal flotation device according to this invention, is generally designated as 50. Many of the components of the personal flotation device 50 are identical to those described with regard to the personal flotation device 10. The difference between the personal flotation device 50 and that of the personal flotation device 10 is that the personal flotation device 50 is a vest type. A back portion 51 has been added to make the personal flotation device 50 a vest. The back portion 51 may include a buoyant material to provide for additional flotation.

Figure 7:
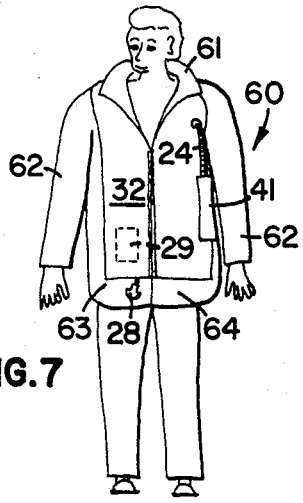
FIG. 7 is a front plan view of another embodiment incorporating my present invention.

Referring now to FIG. 7, another embodiment of the personal flotation device according to this invention, is generally designated as 60. Many of the components of the personal flotation device 60 are identical to those described with regard to the personal flotation device 10.

The difference between the personal flotation device 60 and that of the personal flotation device 10 is basically that the personal flotation device 60 is in the form of a jacket. A collar 61 has been added to the neck opening to provide a more jacket like appearance. Sleeves 62 have likewise been added to cover the arms of a wearer. The right front panel 63 and left front 64 are relatively longer than the corresponding right front panel 14 and left front panel 15 of the personal flotation device 10. A back portion has also been added to complete the jacket appearance.

Figure 10:
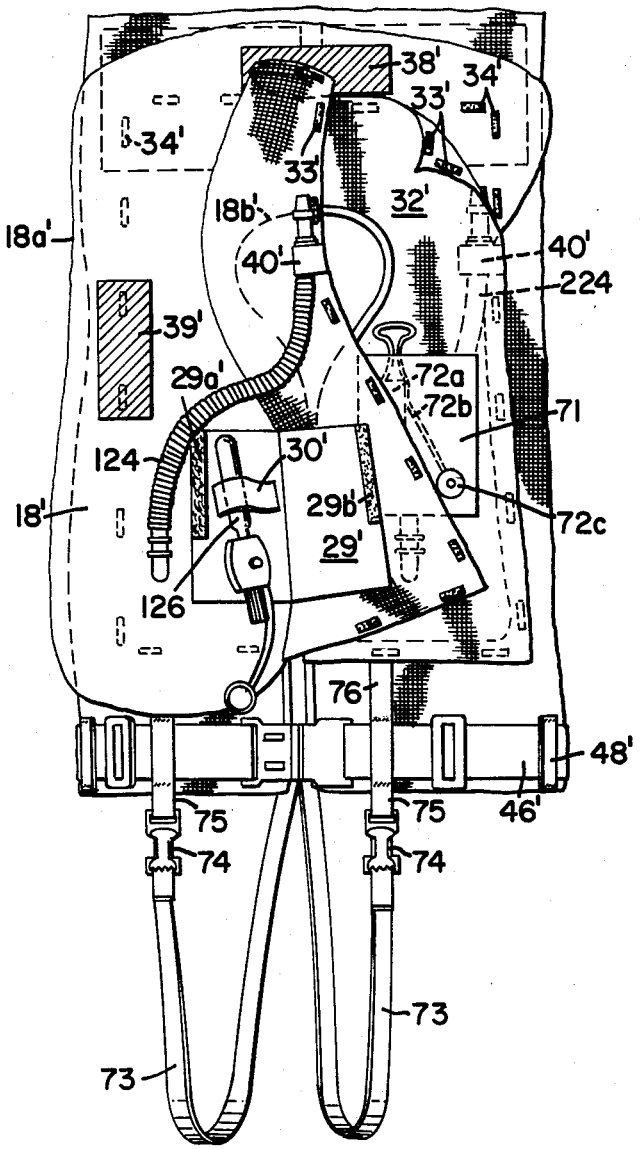
FIG. 10 is a front plan view of the embodiment shown in FIG. 9, with portions of the covering panel being released.

Referring now to FIGS. 9 and 10, another embodiment of the personal flotation device according this invention, is generally designated at 70. Many of the components of the personal flotation device 70 are identical to those described with regard the personal flotation device 10. Those components that are similar will be referred to as a "'".

The hybrid personal flotation device 70 has an interior panel 11' having three chambers with a mass of buoyant material positioned in the chambers. The flotation device 70 has a right front panel 14', left front panel 15', neck opening 16' and a back collar section 17'.

An inflatable buoyancy chamber 18' is connected to the interior panel 11'. The inflatable buoyancy chamber 18' has an outside edge 18*a'* and an interior edge 18*b'*. The interior edges 18*b'* are cooperatively connected to the interior panel 11' and the outer edges 18*a'* are unattached to the interior panel 11'. The buoyancy chamber 18*b'*, an outer member, separation member and inner member forming an inflatable buoyancy chamber having two separately inflatable chambers. Similar to the buoyancy chamber 18, the buoyancy chamber 18' has an air chamber and a carbon dioxide chamber.

Cooperatively connected to the buoyancy chamber 18' are retroreflective strips 38' and radar reflective strips 39'.

The hybrid personal flotation device 70 has two oral inflater tubes 124 and 224 of a construction similar to the oral inflator tube 24. The first oral inflater tube 124 is cooperatively connected to the buoyancy chamber 18' and in fluid communication with the carbon dioxide chamber. The second oral inflater tube 224 is cooperatively connected to the buoyancy chamber 18' and is in fluid communication with the air chamber. A gas cartridge 126 is cooperatively connected to the buoyancy chamber 18' and is in fluid communication with the carbon dioxide chamber. In a preferred embodiment, the gas charge cartridge is a commercially available, miniature, automatic inflation system having a manual override lanyard. This type of mechanism is automatically activated when placed in water and will inflate the carbon dioxide chamber of the personal flotation device 70 in a matter of seconds. This mechanism is secured to the buoyancy chamber in accordance with the procedure described in U.S. Pat. No. 3,754,731 issued Aug. 28, 1973 to Mackal et al. for an "inflation manifold valve and flange assembly". This particular assembly is not specifically claimed in the present invention, but is the preferred mechanism for providing an automatic inflating means for the present invention. The relevant parts of U.S. Pat. No. 3,754,731 are incorporated herein by reference in sufficient detail to enable a person skilled in the art to make and use the present invention.

The top portion of the gas cartridge 126 is secured by means of a holding strip 30' and is covered by a cover 29' having velcro fasteners 29*a'* and 29*b'*.

The wearer of the personal flotation device 70 may inflate the carbon dioxide chamber by either blowing air through the oral inflater tube 124 or by activating the carbon dioxide gas cartridge 126. The oral inflator tube 124 is used for releasing either the air or carbon dioxide that has been placed in the carbon dioxide chamber by simply pressing down the mouth piece end of the oral inflater tube 124. Similarly, the oral inflater tube 224 is used to inflate and deflate the air chamber of the buoyancy chamber 18'. The buoyancy chamber 18' is secured to the lower portion of a interior panel 11' by means of straps 76. The straps 76 have a first end secured to the buoyancy chamber 18' and a second end secured to the lower portion of the interior panel 11'.

Unlike the hybrid flotation device 10, the oral inflater tubes 124 and 224 are hidden from view when the cover 32' is secured to the interior panel 11' by means of velcro strips 33' and 34'. Holding strips 40' secure the oral inflater tubes 124 and 224 underneath the cover 32' and on top of the buoyancy chamber 18'.

A rescue light having a battery pack 72*a* connected by means of a wire 72*b* to a light 72*c*. The battery 72*a* is activated by immersing the battery in water. When the battery 72*a* is activated, the light 72*c* will light up, thereby providing a rescue light. The battery 72*a* fits inside the pocket 71 and the light 72*c* is cooperatively connected to the outside of the pocket 71.

A belt 46' is secured to the bottom portion of the flotation device 70 by loops 48'. A crotch strap 73 is secured to the personal flotation device 70 by means of loops 75 that are secured to the bottom edge of the interior panel 11'. The length of the crotch strap 73 are adjustable by means of the buckles 74. The crotch strap 73 prevents the personal flotation device 70 from riding up on the wearer when the wearer enters the water.

A mesh backing 73 is cooperatively connected to the edges of the interior panel 11'. The mesh backing 74 encloses the back and sides of the personal flotation device 70. However, the mesh backing still allows for ventilation and does not add appreciably to the weight of the overall flotation device.

Tie strings 77 provide for securing the right front panel 14' to the left front panel 15'.

The operation of both the personal flotation device 50 and the personal flotation device 60 is similar to that of the personal flotation device 10.

The operation of the personal flotation device 70 is similar to that of the personal flotation device 10 with those changes previously described above.

Other modifications of the invention will be apparent to those skilled in the art in light of the foregoing description. This description is intended to provide specific examples of individual embodiments which clearly disclose the present invention. Accordingly, the invention is not limited to these embodiments or to the use of elements having specific configurations and shapes as presented herein. All alternative modifications and variations of the present invention which follows in the spirit and broad scope of the appended claims are included.

I claim:

1. A hybrid personal flotation device comprising:

(a) a panel portion having a mass of buoyant material, said panel portion having an inner surface and an outer surface, said inner surface being adjacent a wearer's body;

(b) a buoyancy chamber having an interior zone and a peripheral zone, a portion of said interior zone cooperatively connected to said panel portion, said peripheral zone being unattached to said panel portion, whereby said peripheral zone may be folded and when said buoyancy chamber is folded, said buoyancy chamber covers a smaller area than when said buoyancy chamber is unfolded;

(c) means for inflating said buoyancy chamber; and (d) a covering panel cooperatively connected to said panel portion, said buoyancy chamber positioned between said panel portion and said covering panel, said covering panel having outer edges releasably connected to said panel portion, whereby when said buoyancy chamber is uninflated, said outer edge of said covering panel is secured to said panel portion and said buoyancy chamber is folded and hidden from view by said covering panel and when said buoyancy chamber is inflated, said outer edges of said covering panel are released and said buoyancy chamber expands, unfolds and is visible.

2. The hybrid personal flotation device of claim 1, wherein said buoyancy chamber is of a safety color, wherein said safety color is only visible when said buoyancy chamber expands.

3. The hybrid personal flotation device of claim 1, wherein said inflatable buoyancy chamber includes first and second chambers, and wherein said inflating means includes a first inflating means for inflating said first chambers and a second inflating means for inflating said second chambers of said buoyancy chamber.

4. The hybrid personal flotation device of claim 3, further comprising a pressure relief valve in fluid communication with one of said chambers.

5. The hybrid personal flotation device of claim 1, further comprising retroreflective tape secured to said buoyancy chamber.

6. The hybrid personal flotation device of claim 1, further comprising radar reflective tape secured to said buoyancy chamber.

7. The hybrid personal flotation device of claim 1, wherein said flotation device is a backless vest flotation device.

8. The hybrid personal flotation device of claim 1, wherein said flotation device is a vest flotation device having a mesh fabric back.

9. The hybrid personal flotation device of claim 1, wherein said flotation device is a jacket flotation device.

10. The hybrid personal flotation device of claim 1, wherein said inflatable buoyancy chamber is of a general shape of a horseshoe, wherein the gas in said inflatable buoyancy chamber is free to move throughout said buoyancy chamber.

11. A hybrid personal flotation device of the type having a required buoyancy, said hybrid personal flotation device comprising:

(a) a panel portion having a mass of buoyant material, said panel portion having an inner surface and and outer surface, said inner surface being adjacent a wearer's body, said buoyant material providing an amount of inherent buoyancy;

(b) an inflatable buoyancy chamber having an interior zone and a peripheral zone, a portion of said interior zone cooperatively connected to said panel portion, said peripheral zone being unattached to said panel portion, whereby said peripheral zone may be folded and when said buoyancy chamber is folded, said buoyancy chamber covers a smaller area than when said buoyancy chamber is unfolded;

(c) means for inflating said buoyancy chamber with gas for providing supplemental buoyancy;

(d) means for deflating said buoyancy chamber, whereby after factory testing of said inflatable buoyancy chamber by inflating and deflating said buoyancy chamber, a residual amount of gas that is used to inflate said buoyancy chamber remains in said buoyancy chamber after deflation and provides an amount of residual buoyancy, said inherent buoyancy plus said residual buoyancy being greater than or equal to the required buoyancy; and (e) a covering panel cooperatively connected to said panel portion, said buoyancy chamber positioned between said panel portion and said covering panel, said covering panel having outer edges releasably connected to said panel portion, whereby when said buoyancy chamber is uninflated, said outer edge of said covering panel is secured to said panel portion and said buoyancy chamber is folded and hidden from view by said covering panel and when said buoyancy chamber is inflated, said outer edges of said covering panel are released and said buoyancy chamber expands, unfolds and is visible.

* * * * *